US005658155A

United States Patent [19]

McFarlane et al.

[11] Patent Number: 5,658,155

[45] Date of Patent: Aug. 19, 1997

[54] ELECTRICAL CONNECTOR WITH TERMINAL TAIL ALIGNING DEVICE

[75] Inventors: Walter Graham McFarlane, Elgin; Frank A. Harwath, Downers Grove, both of Ill.

[73] Assignee: Molex Incorporated, Lisle, Ill.

[21] Appl. No.: 584,481

[22] Filed: Jan. 11, 1996

[51] Int. Cl.[6] ..... H01R 9/09

[52] U.S. Cl. ..... 439/79

[58] Field of Search ..... 439/79, 80, 629

[56] References Cited

U.S. PATENT DOCUMENTS 5,433,624 7/1995 Tabata ..... 439/79

*Primary Examiner*—Gary F. Paumen
*Assistant Examiner*—Christopher Goins
*Attorney, Agent, or Firm*—Charles S. Cohen

[57] ABSTRACT

An electrical connector includes a dielectric housing having a plurality of terminals therein. Each terminal has a tail portion projecting from the housing. A tail aligning device is secured to the housing and an intersection between the housing and the tail aligning device captures some of said tail portions of the terminals.

15 Claims, 6 Drawing Sheets

ELECTRICAL CONNECTOR WITH TERMINAL TAIL ALIGNING DEVICE

FIELD OF THE INVENTION

This invention generally relates to the art of electrical connectors and, particularly, to an electrical connector which includes one or more separate terminal modules and a separate terminal tail aligning device.

BACKGROUND OF THE INVENTION

As electronic components have become more miniaturized, it has become desirable to also miniaturize the electrical connectors that are used with such components. One aspect of such miniaturization is to reduce the size of the "foot print" required by an electrical connector mounted on a printed circuit board. In other words, it is desirable to reduce the amount of space on the printed circuit board required by the electrical connector.

In addition to reducing the size of the electrical connectors, it is also desirable to reduce the costs and complexity involved with their manufacture. Right angle input/output (I/O) connectors typically have a connector housing with a plurality of terminals mounted therein. The terminals typically include a contact portion at a mating face of the electrical connector and tail portions extending from a mounting or terminating face for soldering to conductive circuit traces on a printed circuit board. In order to maintain the exact position of the tails prior to mounting the electrical connector on a printed circuit board and to generally protect the tails, tail aligners are typically used in connection with such connectors. These tail aligners generally have a plurality of rows of holes through which the tails of the terminals extend. The tail aligner and the connector housing generally include some type of means for securing the tail aligner to the housing. One problem associated with tail aligners is the potential difficultly of inserting all of the terminal tails through the holes in the tail aligner. In other words, as the number of terminals in the connector increases, the potential for misalignment between the terminal tails and the holes in the tail aligner increases, thus potentially making the job of assembling the tail aligners onto the connector housing more difficult.

This invention is directed to solving the problems identified above and providing an improved way of positioning terminals through the use of a tail aligner as well as permitting the miniaturization of the connector assembly.

SUMMARY OF THE INVENTION

An object, therefore, of the invention is to provide a new and improved connector housing and tail aligning structure.

In the exemplary embodiment of the invention, the electrical connector includes a dielectric housing having a mating face, a rear face opposite the mating face and a board mounting face. An array of terminals is received in the housing with each terminal including a contact portion generally adjacent the mating face, a rear portion projecting from the rear face and a tail portion extending at an angle to the rear portion to the terminal. The array also includes first and second generally parallel rows of tail portions with the first row of tail portions extending along a tail capturing portion of the rear face of the housing adjacent the board mounting face thereof. A tail aligning device is mounted on the housing and has a plurality of apertures through which the second row of tail portions of the terminals extend. The tail aligning device further includes a tail capturing surface extending along a leading edge of the tail aligning device. The tail capturing portion of the rear face of the housing and the tail capturing surface of the tail aligning device are positioned adjacent each other to capture the first row of tail portions of the terminals therebetween.

The tail capturing portion of the rear face of the housing and the tail capturing surface of the tail aligning device may be configured to define a row of apertures through which the first row of tail portions extend. In one embodiment, a majority of each aperture is defined by the tail capturing portion of the rear face of the housing. In another embodiment, a majority of each aperture is define by the tail capturing surface of the tail aligning device.

Other objects, features and advantages of the invention will depend from the following detail description taken in connection in the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
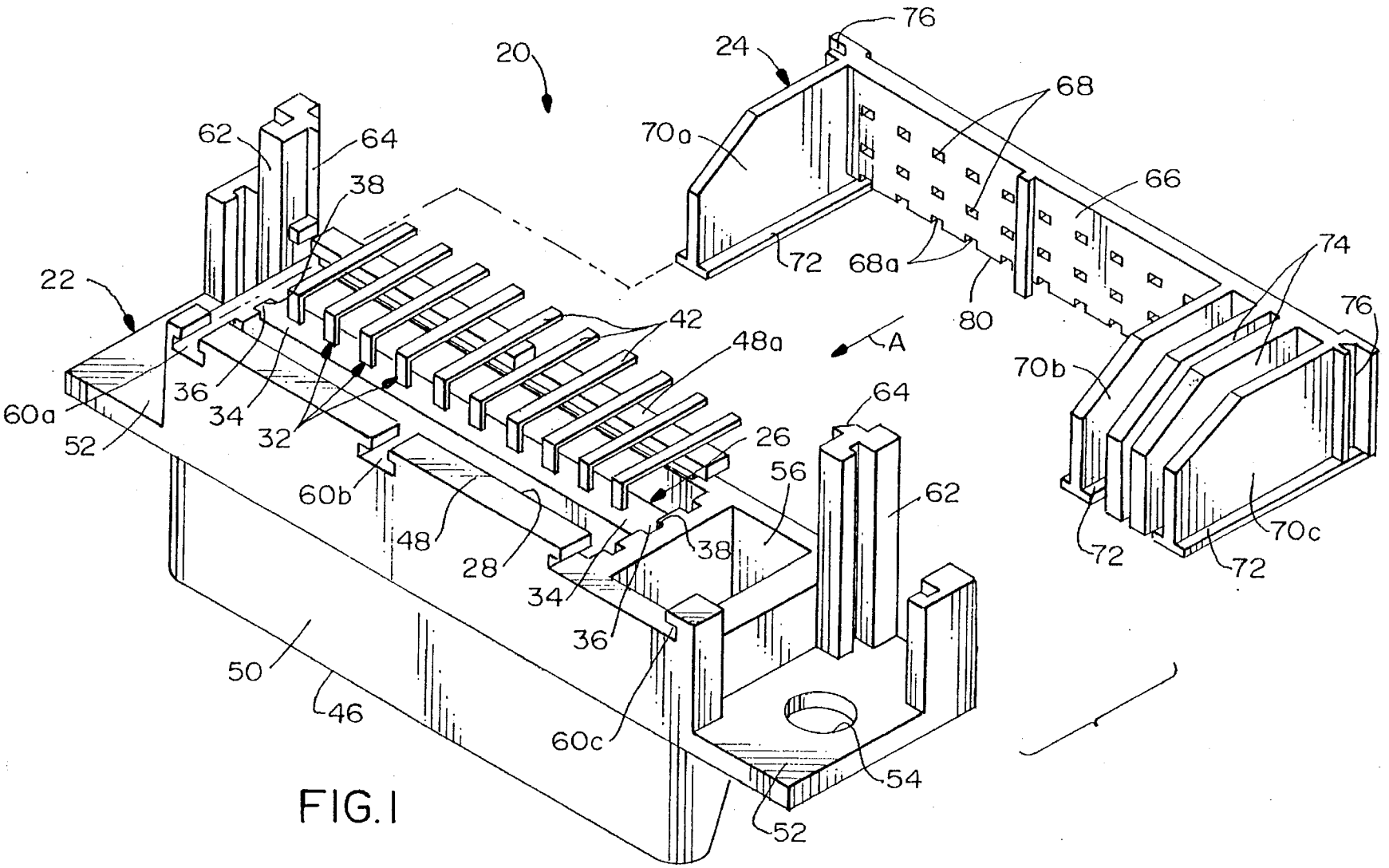
FIG. 1 is an exploded perspective view of an electrical connector embodying the concepts of the invention, looking downwardly toward the rear terminating face of the connector.

Referring to the drawings in greater detail, and first to FIG. 1, the invention is embodied in an electrical connector, generally designated 20. The connector generally is formed of two basic components, namely an elongated dielectric housing, generally designated 22, and an elongated tail aligning device, generally designated 24, along with one or more terminal modules, generally designated 26. Each of the housing and the tail aligning device is formed as a one-piece molded dielectric component, such as of plastic material or the like.

Figure 2:
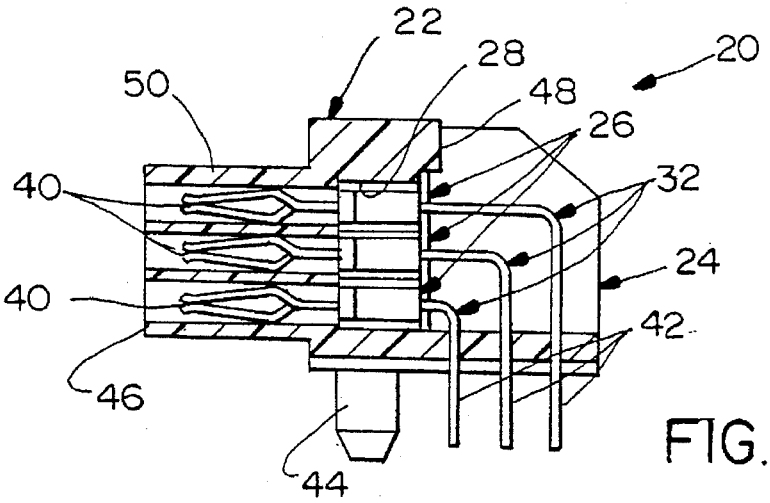
FIG. 2 is a vertical section through the connector in assembled condition.
Figure 3:
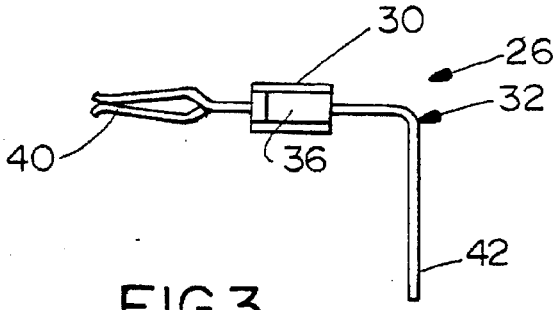
FIG. 3 is an end elevational view of the top terminal module as seen in FIG. 2.
Figure 4:
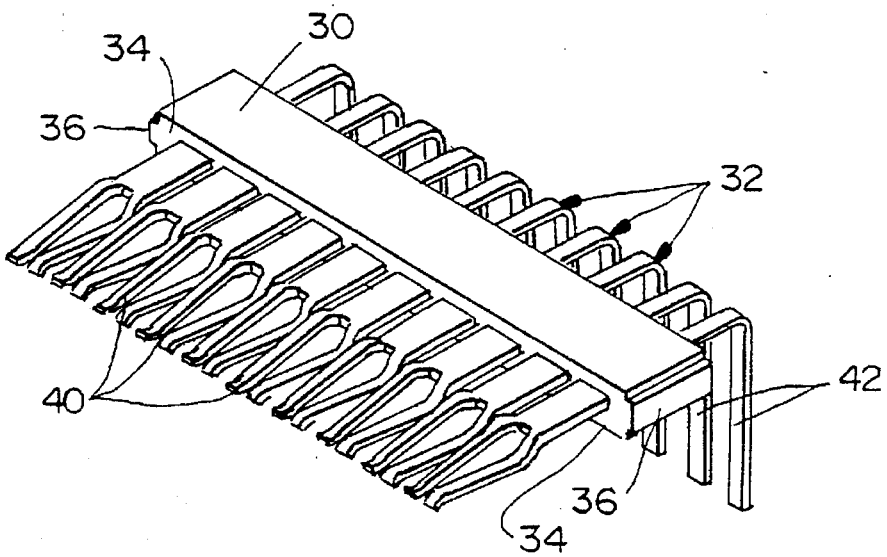
FIG. 4 is a perspective view of the terminal module.
Figure 6:
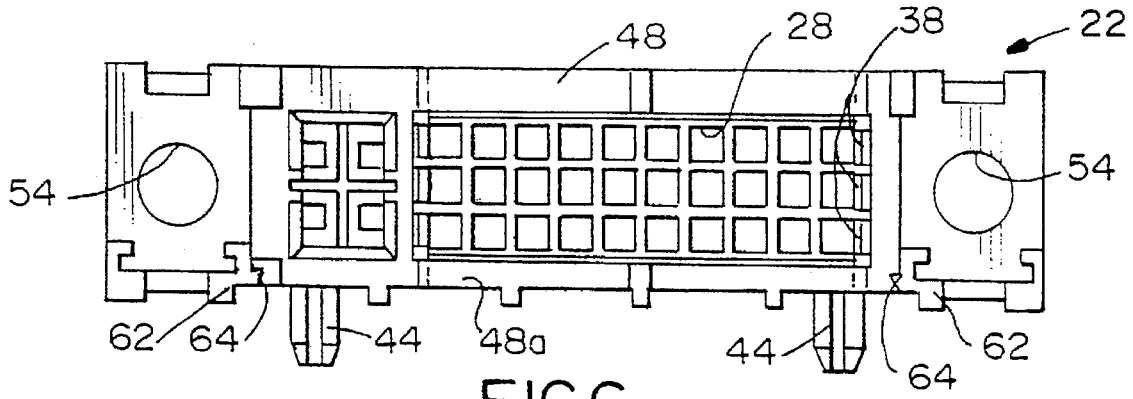
FIG. 6 is an elevational view of the rear terminating face of the connector housing.
Figure 7:
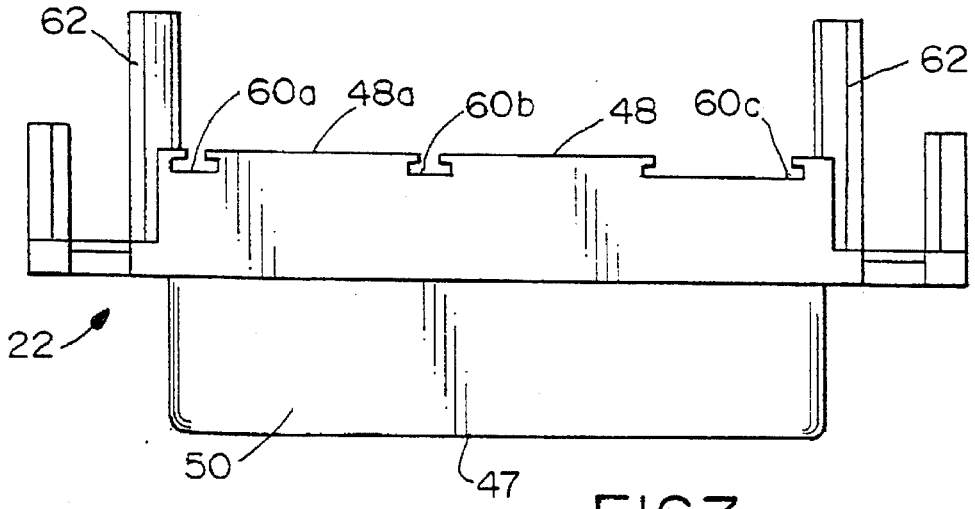
FIG. 7 is a top plan view of the connector housing.
Figure 5:
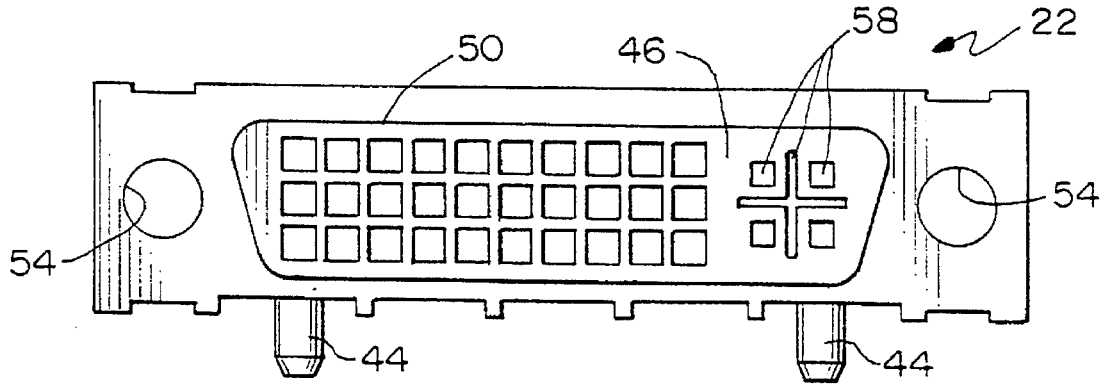
FIG. 5 is an elevational view of the front mating face of the connector housing.
Figure 8:
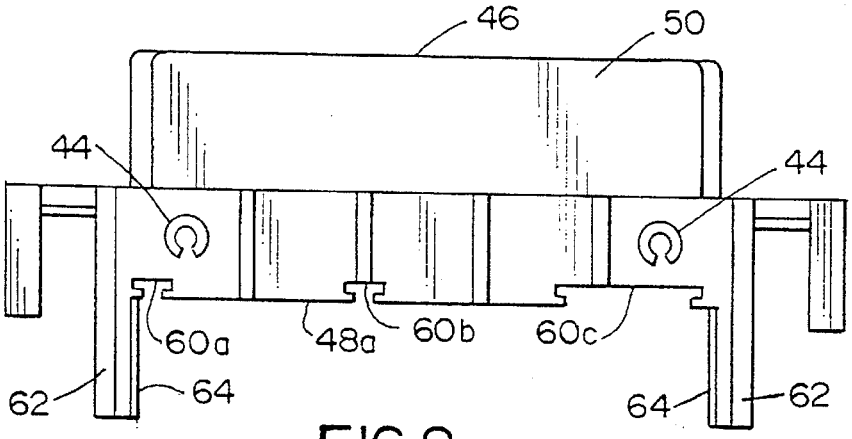
FIG. 8 is a bottom plan view of the connector housing.

Before proceeding with a detailed description of housing 22 and tail aligning device 24, reference is made to FIGS. 2–4 in conjunction with FIG. 1. FIG. 2 shows three terminal modules 26 mounted within an elongated cavity 28 of housing 22, the only difference in the modules being the lengths of the tail portions of the terminals described hereinafter. On the other hand, FIG. 1 shows only one terminal module 26 mounted within cavity 28. It should be understood that one of the advantages of the invention is that connector 20 can accommodate a plurality of terminal modules or only one, according to the specifications of the connector.

Still referring to FIGS. 2–4 in conjunction with FIG. 1, each terminal module 26 includes an elongated dielectric insert 30 shaped in the form of a plastic bar which is overmolded about a linear array of terminals, generally designated 32. The dielectric insert of each terminal module extends at opposite ends beyond the linear array of terminals, as at 34 (FIG. 4), and terminates in a rib 36 at the extreme opposite ends of the insert. As seen in FIG. 1, the ribs are positionable into grooves 38 at opposite ends of elongated cavity 28. Each terminal 32 includes a forwardly projecting contact portion 40 and a rearwardly projecting, right angled tail portion 42. Therefore, electrical connector 20 is a right-angle connector as seen best in FIG. 2, for mounting on a printed circuit board, with mounting posts 44 of connector housing 22 extending into appropriate mounting holes in the board, and with tail portions 42 of the terminals projecting into circuit holes in the board.

Referring to FIGS. 5–8 in conjunction with FIGS. 1 and 2, elongated dielectric housing 22 has a front mating face 46 and a rear terminating face 48 with the terminal module-receiving cavity 28 extending generally therebetween. Actually, the front mating face of the housing is defined by a D-shaped mating end 50 of the housing as is conventional with many such I/O electrical connectors. A shield (not shown) may be added to the front mating face 46 if desired. End portions 52 of the housing include apertures 54 for receiving appropriate fastening means to secure the connector to an appropriate complementary mating connector (not shown). Still further, the housing includes a rearwardly opening side cavity 56 (FIG. 1) which communicates through openings 58 (FIG. 5) in front mating end 50 to accommodate various high speed terminal means which do not form part of the invention herein and will not be described further.

Figure 13:
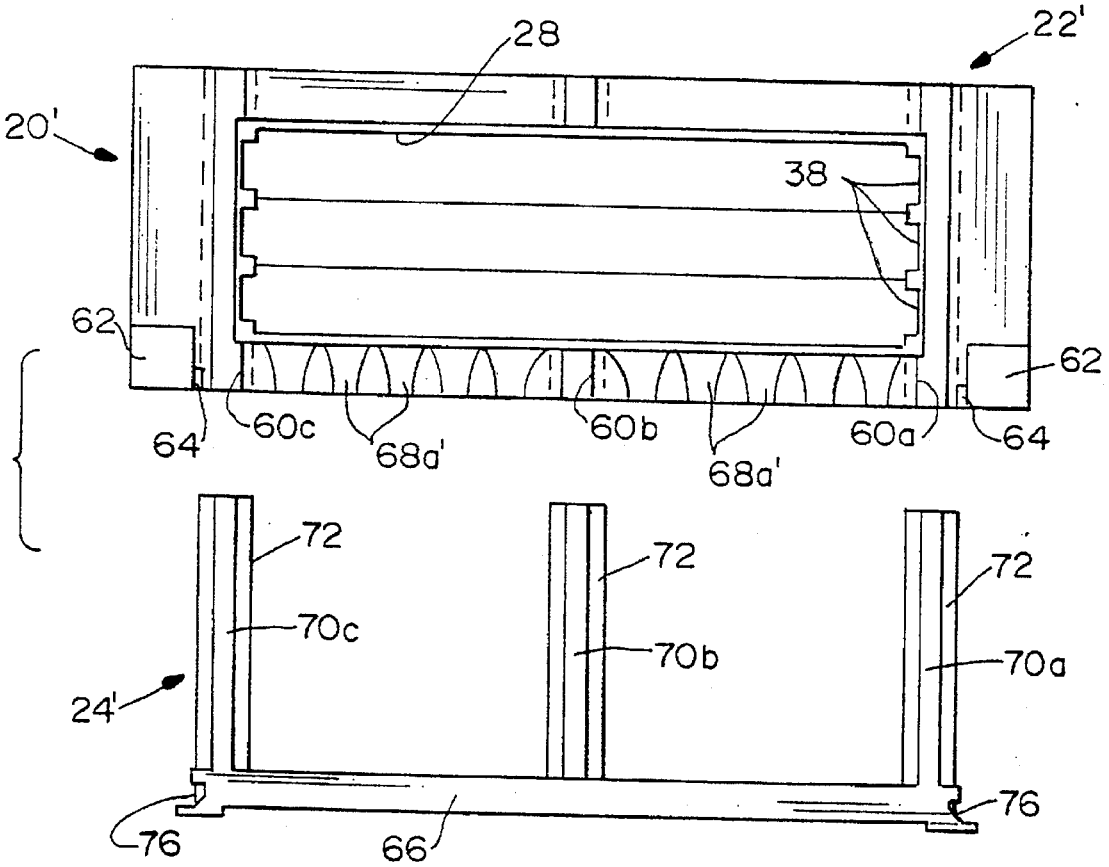
FIG. 13 is an exploded elevational view of the connector of FIG. 12.

According to the invention, dielectric housing 22 includes a plurality of guide channels 60*a*, 60*b* and 60*c* (FIGS. 1 and 7) for guiding tail aligning device 24 into position, as described hereinafter. It can be seen that the left-hand (as viewed in FIGS. 1, 7 and 8) guide channel 60*a* and the center guide channel 60*b* are narrower than the right-hand guide channel 60*c*. The guide channels are generally T-shaped. If desired, as shown in FIG. 13, the outer portions 60*a'* and 60*c'*, respectively, of the guide ribs 60*a* and 60*c* could extend along generally the entire height of the connector in order to provide additional guiding during assembly and strength after assembly of the connector.

According to the invention, dielectric housing 22 further includes a pair of upstanding latch posts 62 near opposite ends 52 of the housing, with chamfered latching ribs 64 facing inwardly of the elongated housing. The latching ribs function to latch tail aligning device 24 in proper position, as described hereinafter.

Figure 11:
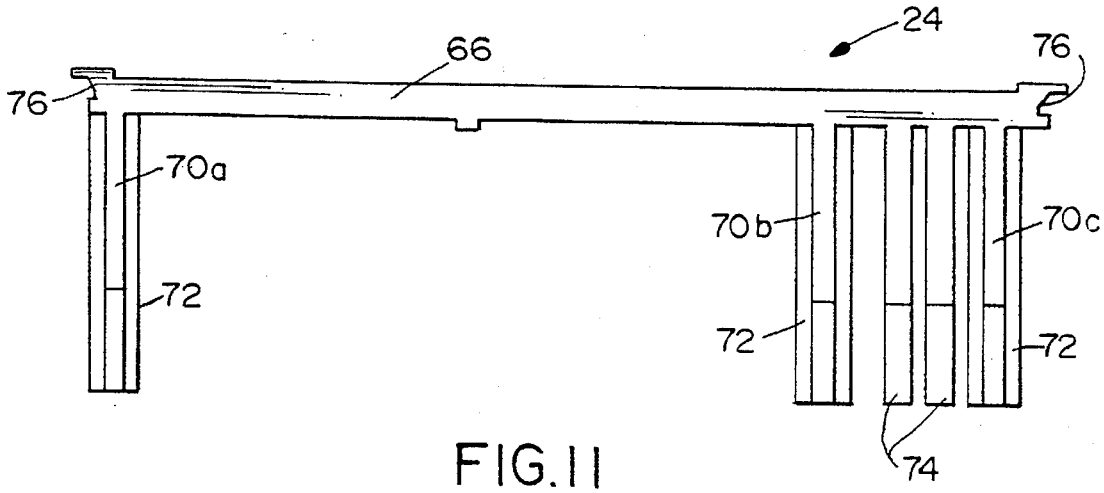
FIG. 11 is a top plan view of the tail aligning device, as viewed in FIG. 1.
Figure 9:
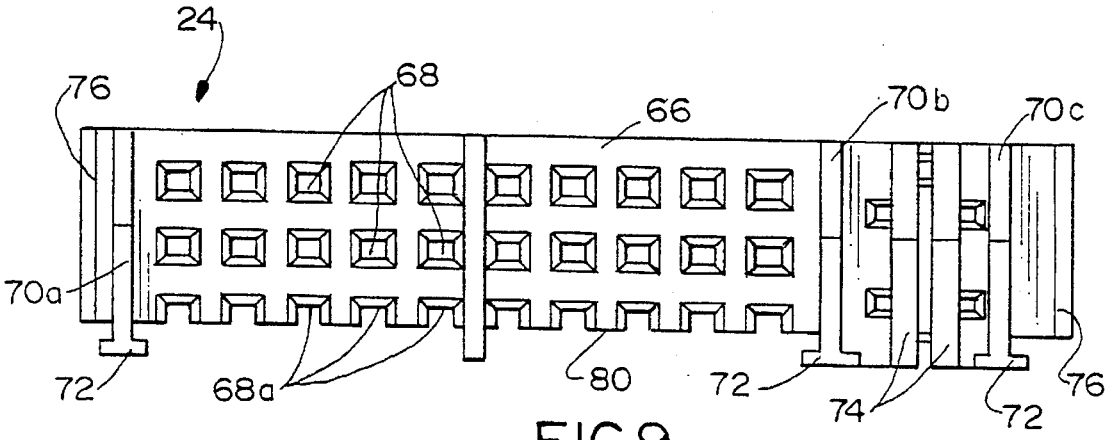
FIG. 9 is a front elevational view of the tail aligning device, as viewed in FIG. 1.
Figure 10:
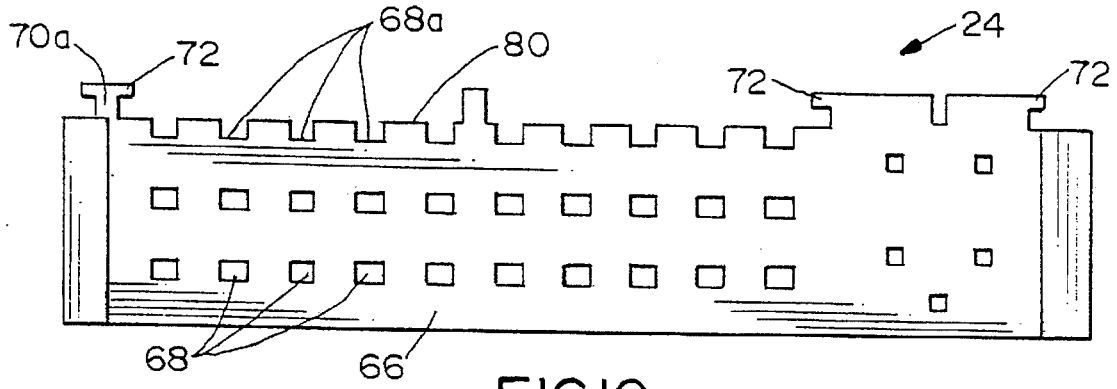
FIG. 10 is a rear elevational view of the tail aligning device.

Referring to FIGS. 9–11 in conjunction with FIG. 1, tail aligning device 24 includes an elongated plate portion 66 having a plurality of apertures 68 through which tail portions 42 of terminals 32 project. One function of the tail aligning device, of course, is to maintain the tail portions of the terminals in proper position and spacing. The tail aligning device further includes a plurality of gussets 70*a*, 70*b* and 70*c* having flanges or rails 72 at the front edges thereof. The flanges cooperate with the gussets to form T-shaped guide rails which ride within guide channels 60*a* and 60*c* of connector housing 12. Spacers 74 are formed between gussets 70*b* and 70*c* for purposes not germane to the invention and will not be further described.

Tail aligning device 24 further includes latch grooves 76 (FIG. 11) which face outwardly at opposite ends of plate portion 66 of the device. These latch grooves cooperate with latching ribs 64 of connector housing 22, as described below.

In assembly of electrical connector 20, one or more terminal modules 26 are inserted into elongated cavity 28 as shown in FIGS. 1 and 2. When inserted, ribs 36 at opposite ends of dielectric inserts 34 of the terminal modules ride into grooves 38 at opposite ends of housing cavity 28. No independent latching means are provided between the terminal modules and the connector housing. Although it may be desirable to create an interference fit between the terminal modules and the housing, such interference fit would be sufficient to hold the modules in place during assembly, but not during mating of intermating connectors.

Figure 14:
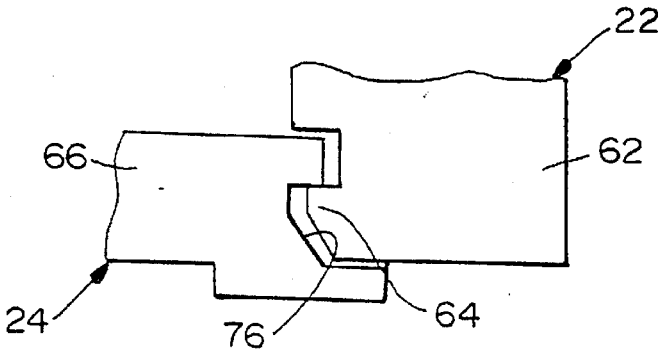
FIG. 14 is a fragmented plan view, on an enlarged scale, of the snap-latch means between the connector housing and the tail aligning device.

Tail aligning device 24 then is assembled to connector housing 22 in the direction of arrow "A" (FIG. 1). During assembly, tail portions 42 of terminals 32 move into apertures 68 in the tail aligning device. The guide rails of the device formed by gussets 70*a*–70*c* and flanges 72 ride into guide channels 60*a*–60*c* of the connector housing. When the tail aligning device is fully assembled, latching ribs 64 which face inwardly of latch post 62 of the connector housing snappingly latch into latch grooves 76 at opposite ends of the tail aligning device. When the tail aligning device is assembled to the connector housing, a portion of the flanges 72 of gussets 70*a* and 70*b* of the tail aligning device engage opposite ends 34 of terminal modules 26 to hold the modules in housing cavity 28 in response to mounting the tail aligning device on the housing. In other words, the tail aligning device performs the dual function of not only aligning the tail portions of the terminal but also holding the terminal modules within the housing without requiring any extraneous latching means between the module and the housing. FIG. 14 shows the latched condition of latching ribs 64 on mounting post 62 of the connector housing within latch grooves 76 of the tail aligning device. Terminal modules (not shown) similar to those shown in FIGS. 3 and 4 may also be inserted into side cavity 56. In such case, flanges 72 of gussets 70*b* and 70*c* would hold such modules within cavity 56 in a manner similar to that described above.

FIG. 10 shows a feature of the invention wherein it can be seen that one row of apertures 68*a* in tail aligning device 24 are open at a front edge 80 of plate portion 66. When the tail aligning device 24 is in place on the housing, the lower rear edge 48*a* of rear terminating face 48 of the housing interacts with the open apertures 68*a* to close the open side and encircle the terminal tails to hold them in place. This allows for the width dimensions of the tail aligning device to be reduced. In addition, open apertures 68a make assembly of the connector less difficult since only some but not all (two-thirds in the embodiments shown) of the terminal tails must be aligned with and inserted into apertures 68.

Figure 12:
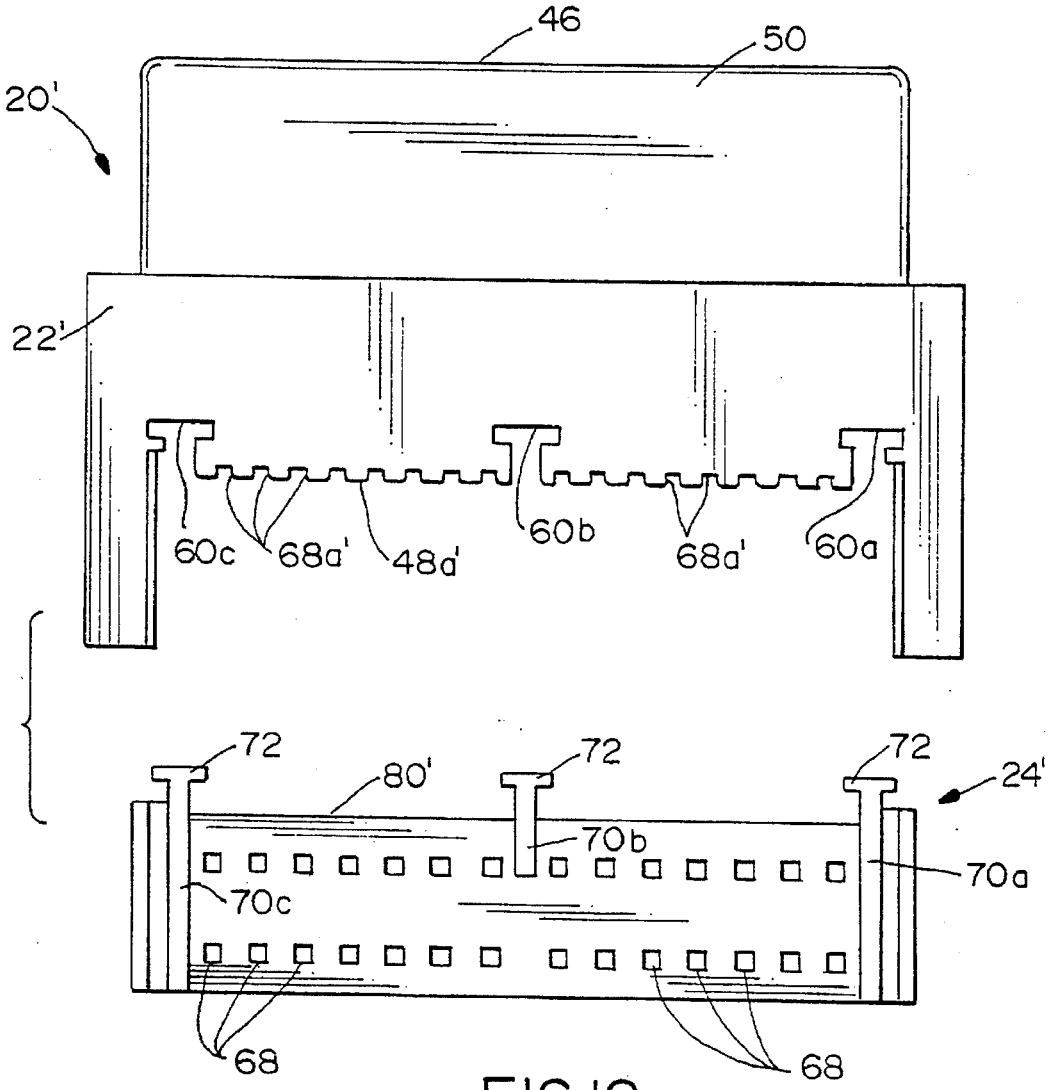
FIG. 12 is an exploded plan view of an alternate form of electrical connector including the connector housing and tail aligning device.

Lastly, FIGS. 12 and 13 show an alternative, more simplified electrical connector 20' having a dielectric housing 22' and a tail aligning device 24'. In this connector, the tail aligning device has three T-shaped guide rails formed by flanges 72 receivable into three guide channels 60. In other words, a center guide rail and a center guide channel are provided intermediate opposite ends of the housing and tail aligning device. The center-most guide rail and guide channel engages the dielectric insert of the terminal module(s) near the center thereof. This embodiment might be used to further support the dielectric inserts of the terminal modules and prevent them from bowing near the center thereof, such as in electrical connectors that are more elongated than those shown herein.

FIG. 12 also shows an additional embodiment of the interaction between the tail aligning device and the housing to hold the terminals in place. In that embodiment, the open row of apertures 68*a'* are moved to the lower edge 48*a'* of the rear terminating face. The front or leading edge 80' is relatively planar or smooth in order to close the open side of apertures 68*a'* and encircle the terminals.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A right angle electrical connector, comprising:

a dielectric housing having a mating face, a rear face opposite said mating face and a board mounting face;

an array of terminals received in the housing, each terminal including a contact portion generally adjacent said mating face, a rear portion projecting from the rear face and a tail portion extending at an angle to said contact portion of the terminal, said array of terminals including first and second generally parallel rows of tail portions, said second row of tail portions extending along a tail capturing portion of said rear face of said housing and past said board mounting face;

a tail aligning device secured to the housing and having a row of first apertures through which said first row of tail portions of the terminals extend, said tail aligning device further including a tail capturing surface extending along a leading edge thereof; and said tail capturing portion of said rear face of said housing and said tail capturing surface of said tail aligning device being positioned adjacent to each other to capture said second row of tail portions therebetween.

2. The electrical connector of claim 1 wherein said tail capturing portion of said rear face of said housing and said tail capturing surface of said tail aligning device define a row of second apertures through which said second row of tail portions extend.

3. The electrical connector of claim 2 wherein a majority of each said second aperture is defined by said tail capturing portion of said rear face of said housing.

4. The electrical connector of claim 2 wherein a majority of each said second aperture is defined by said tail capturing surface of said tail aligning device.

5. The electrical connector of claim 1 wherein one of said tail capturing portion of said rear face of said housing and said tail capturing surface of said tail aligning device includes a row of vertical channels through which said second row of tail portions extend and the other of said tail capturing portion of said rear face of said housing and said tail capturing surface of said tail aligning device has a generally flat surface.

6. The electrical connector of claim 5 wherein said tail capturing portion of said rear face of said housing includes said row of vertical channels through which said second row of tail portions extend and said tail capturing surface of said tail aligning device has said generally flat surface.

7. The electrical connector of claim 1 wherein said rear portion of each terminal is generally parallel to said contact portion and said tail portion is generally perpendicular to said contact portion.

8. A right angle electrical connector, comprising:

a dielectric housing having a mating face, a rear face opposite said mating face and a board mounting face;

an array of terminals received in the housing, each terminal including a contact portion generally adjacent said mating face, and a tail portion extending generally perpendicularly to said contact portion of the terminal, said array of terminals including first and second generally parallel rows of tail portions, said second row of tail portions extending along a tail capturing portion of said rear face of said housing adjacent said board mounting face; a tail aligning device mounted on the housing and having a row of first apertures through which said first row of tail portions of the terminals extend, said tail aligning device further including a tail capturing surface extending along said rear face of said housing adjacent said board mounting face;

said tail capturing portion of said rear face of said housing and said tail capturing surface of said tail aligning device being positioned adjacent to each other to capture said second row of tails therebetween, and one of said tail capturing portion of said rear face of said housing and said tail capturing surface of said tail aligning device includes a row of vertical channels through which said second row of tail portions extend and the other of said tail capturing portion of said rear face of said housing and said tail capturing surface of said tail aligning device has a generally flat surface.

9. The electrical connector of claim 8 wherein said tail capturing portion of said rear face of said housing and said tail capturing surface of said tail aligning device define a row of second apertures through which said second row of tail portions extend.

10. The electrical connector of claim 9 wherein a majority of each said second aperture is defined by said tail capturing portion of said rear face of said housing.

11. The electrical connector of claim 9 wherein a majority of each said second aperture is defined by said tail capturing surface of said tail aligning device.

12. The electrical connector of claim 8 wherein said tail capturing portion of said rear face of said housing includes said row of vertical channels through which said second row of tail portions extend and said tail capturing surface of said tail aligning device has said generally flat surface.

13. The electrical connector of claim 8 wherein said tail capturing surface of said tail aligning device includes said row of vertical channels through which said second row of tail portions extend and said tail capturing portion of said rear face of said housing has a generally flat surface.

14. An electrical connector, comprising:

an elongated dielectric housing having terminal-receiving passage means extending therethrough and a terminal tail capturing portion;

a plurality of terminals received in the passage means, each terminal including a tail portion projecting from the housing;

a tail aligning device fixed to the housing and having terminal tail capturing surface, said housing and tail aligning device defining a plurality of apertures through which the tail portions of the terminals extend, at least some of the apertures being defined by an intersection between said terminal tail capturing portion of said housing and said terminal tail capturing surface of said tail aligning device; and wherein one of said tail capturing portion of said housing and said tail capturing surface of said tail aligning device includes a row of vertical channels through which a row of tail portions extend and the other of said tail capturing portion of said housing and said tail capturing surface of said tail aligning device has a generally flat surface.

15. The electrical connector of claim 14 wherein said tail capturing portion of said housing includes said row of vertical channels through which said row of tail portions extend and said tail capturing surface of said tail aligning device has said generally flat surface.

* * * * *